United States Patent [19]

Houser

[11] Patent Number: 4,866,899

[45] Date of Patent: Sep. 19, 1989

[54] METAL STUD

[75] Inventor: James L. Houser, Ann Arbor, Mich.

[73] Assignee: Domatar Inc., Montreal, Canada

[21] Appl. No.: 316,769

[22] Filed: Feb. 28, 1989

Related U.S. Application Data

[63] Continuation-in-part of Ser. No. 33,404, Apr. 1, 1987, abandoned.

[51] Int. Cl.[4] ..... E04B 1/00

[52] U.S. Cl. ..... 52/481; 52/729; 52/735

[58] Field of Search ..... 52/729, 727, 481, 735, 52/281, 715, 282

[56] References Cited

U.S. PATENT DOCUMENTS

| | | | |
|---|---|---|---|
| 1,082,470 | 12/1913 | Phelan | 52/713 |
| 1,088,417 | 2/1914 | Harp | 52/713 |
| 2,154,944 | 4/1939 | Kullmer | 52/481 |
| 2,261,510 | 11/1941 | Atcheson | 52/715 |
| 3,217,460 | 11/1965 | Downing, Jr. | 52/481 |
| 3,303,627 | 2/1967 | Mora | 52/779 |
| 3,839,839 | 10/1974 | Tillisch et al. | 52/738 |
| 3,940,899 | 3/1976 | Balinski | 52/481 |
| 4,047,355 | 9/1977 | Knorr | 52/738 |
| 4,152,873 | 5/1979 | Burke | 52/1 |
| 4,189,893 | 2/1980 | Kuhr | 52/779 |
| 4,364,212 | 12/1982 | Pearson et al. | 52/281 |
| 4,435,936 | 3/1984 | Rutkowski | 52/481 |
| 4,617,770 | 10/1986 | Hickman | 52/214 |

FOREIGN PATENT DOCUMENTS

| | | |
|---|---|---|
| 894706 | 10/1953 | Fed. Rep. of Germany . |
| 172794 | 12/1921 | United Kingdom . |

*Primary Examiner*—Carl D. Friedman
*Assistant Examiner*—Caroline D. Dennison
*Attorney, Agent, or Firm*—Foley & Lardner, Schwartz, Jeffery, Schwaab, Mack, Blumenthal & Evans

[57] ABSTRACT

A one-piece metal stud comprises a longitudinal web with generally centrally located punch outs forming alternately oriented bent tabs, a folded and hemmed front flange, and a back flange formed of alternately oriented bent tabs. The bent tabs are folded into a lip of double thickness and extend back past the web in a single thickness. The punch out tabs and the back flange tabs form channels therebetween on each side of the web for holding a separate wallboard panel in each channel. A further wallboard panel or panels can be fastened to the front flange or to both the front flange and back flange tabs to complete formation of a double-wall or cavity wall construction.

11 Claims, 1 Drawing Sheet

METAL STUD

This is a continuation-in-part of application Ser. No. 033,404, filed Apr. 1, 1987 now abandoned.

FIELD OF THE INVENTION

The present invention relates to the field of wall studs, and more particularly to a one-piece metal wall stud for use as a supporting member in a double-wall or cavity wall construction.

BACKGROUND OF THE INVENTION

A number of types of metal wall studs are currently used in the building industry, for example those disclosed in U.S. Pat. No 4,435,936 as invented by E. Rutkowski and issued on 03/13/84 and U.S. Pat. No. 3,839,839 as invented by P. Tillisch et al and issued on 10/08/74. The latter discloses a stud which defines two channels for holding wallboard panels, one of the channels being solid throughout its length whereas the other channel is solid on one side and intermittent on the other. The first patent discloses a stud defining two channels, both of which are solid on one side and intermittent on the other, thereby using less material than the prior art taught. However, the frequent use for such metal studs in fire-rated walls, such as shaft walls and stairwalls has fueled a continuing goal in the industry to provide a stud which is better suited for use in fire-rated wall; a stud which requires even less metal to make, thereby less costly and lighter, and which is easier to use in constructing a wall.

OBJECTS OF THE INVENTION

Accordingly, it is the object of the present invention to provide a one-piece metal stud which is light in weight, has good structural and thermal characteristics for use in a fire-rated wall, and which simplifies assembly of the wall.

It is a further object of the present invention to provide a one-piece metal stud which enables the passage of electrical, telephone and mechanical service lines, and air, through the stud without interfering with the adjacent wallboard panels.

BRIEF DESCRIPTION OF THE INVENTION

Broadly stated, the present invention is directed to a one-piece metal stud comprising:

a longitudinal web with generally centrally located punch outs forming alternately oriented bent tabs substantially perpendicular to the web;

a folded and hemmed front flange substantially perpendicular to the web;

a back flange formed of alternately oriented bent tabs substantially perpendicular to the web, the bent tabs being folded over into a lip of double thickness and extending back past the web in a single thickness;

the punch out tabs and the back flange tabs being spaced apart and substantially parallel to one another thereby forming a channel therebetween on each side of the web;

whereby a separate wallboard panel can be held in each channel and a further wallboard panel or panels can be fastened to the front flange or to both the front flange and the back flange tabs to complete formation of a double-wall or cavity wall construction.

The present invention is also directed to a fire-rated wall comprising a plurality of spaced apart one-piece metal studs, wherein said studs are mounted in parallel relation with wallboard panels mounted therebetween, whereby a first set of separate wallboard panels are held in each channel and a third wallboard panel is fastened to the front flange.

BRIEF DESCRIPTION OF THE DRAWINGS

Referring now to the drawings which illustrate the invention.

DETAILED DESCRIPTION OF THE PREFERRED EMBODIMENT

Figure 1:
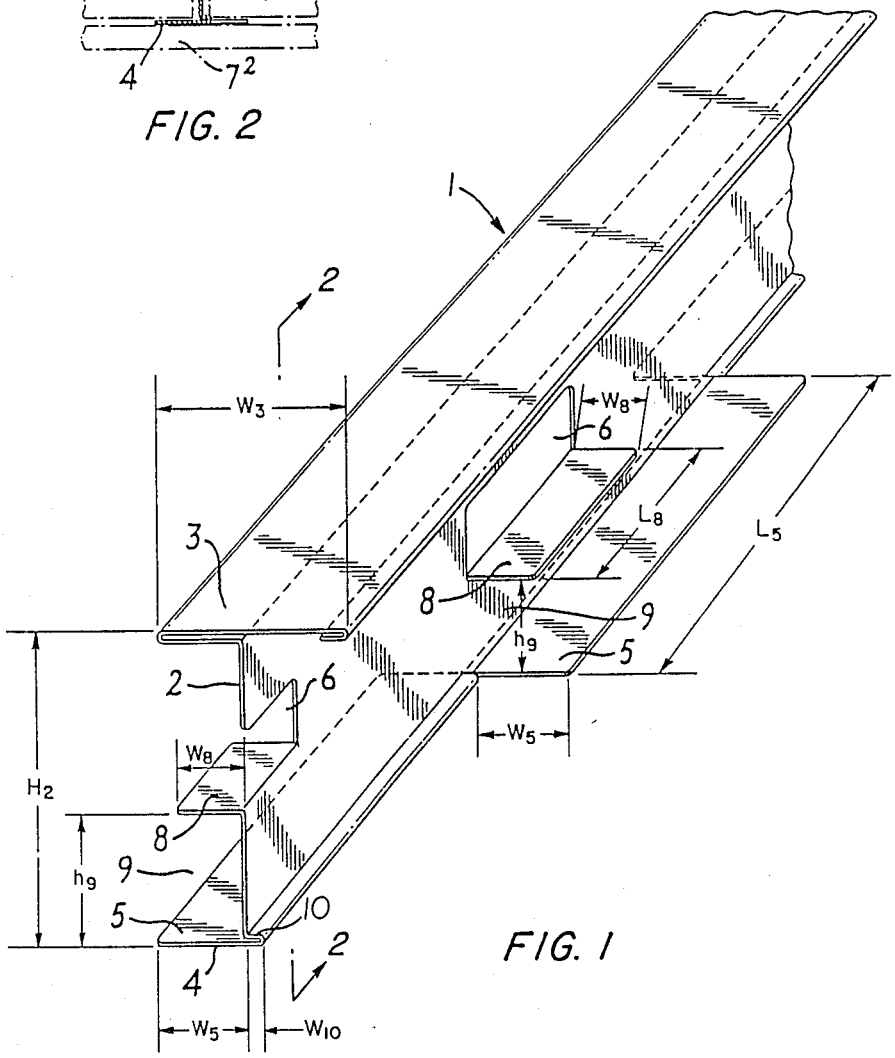
FIG. 1 is a fragmentary perspective view of a wall stud pursuant to the present invention.

As can be seen from FIG. 1, the stud 1 of the present invention is made of sheet of light gauge metal, such as steel or aluminum, roll formed and tab punched as a one-piece unit. Stud 1 includes a longitudinal web 2 separating a folded and hemmed front flange 3 and a back flange 4. Front flange 3 is such that it extends substantially perpendicularly away from web 2, is folded over into a double thickness which further extends past web 2 into a single thickness and is finally folded and hemmed back towards web 2. Back flange 4 is formed of alternately oriented bent tabs 5. Each tab 5 extends substantially perpendicularly from web 2, is folded over into a lip 10 of double thickness which extends back past web 2 in a single thickness. Lip 10 is of a width $W_{10}$ which is generally substantially less than the single thickness portion being of a width $W_5$.

Figure 2:
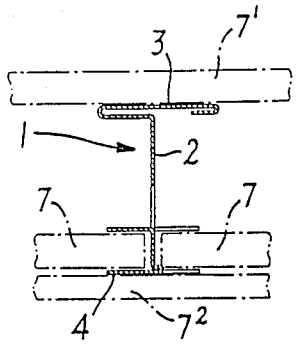
FIG. 2 is a sectional view of the stud in FIG. 1 taken along line 2—2, with wallboard panels attached thereto.

Web 2 is provided with generally centrally located punch outs 6 forming alternately oriented bent tabs 8 substantially perpendicular to the web, and spaced apart and substantially parallel to the alternately oriented bent tabs 5 so as to form channels 9 therebetween on each side of web 2 for holding a separate wallboard panel 7 in each channel 9, as seen in FIG. 2. Tabs 8 and tabs 5 are generally immediately vis-a-vis one another to provide a good holding grip on the wallboard panels. The spaced apart height $H_9$ of channels 9 is substantially equal to the thickness of panel 7. The height $H_2$ of web 2 is generally more than twice height $H_9$ of channels 9.

Width $W_{10}$ of lip 10 is preferably of a width to enable the edge of panels 7, adjacent web 2, to be hidden from view. This is particularly useful, for during construction, one will quickly be able to determine by visual inspection of flange 4, if panels 7 are properly positioned and held in channels 9. Furthermore, this will provide a preferred joint between panels 7 without requiring additional tape or other means to hide the joint. Lip 10 will also be sufficient to hold the wallboard panels to prevent them from warping between tabs 5.

As also seen in FIG. 2, a further wallboard panel or panels $7^1$ can be fastened by known means to front flange 3 to complete formation of a single faced double wall construction. Alternately, a further wallboard panel or panels $7^2$ can be fastened by known means to the back flange tabs 5 to complete formation of a double faced wall construction.

In a preferred embodiment, tabs 5 have a length $L_5$ generally greater than the length $L_8$ of tabs 8. The single thickness portion of tabs 5 have a width $W_5$ substantially equal to width $W_8$ of tabs 8. Width $W_5$ of the single thickness portion of tabs 5 is substantially equal to one-half of the width $W_3$ of front flange 3.

Punch outs 6 are generally in the portion of web 2 between punch out tabs 8 and front flange 3, and they permit the passage of cooling air along the interior of the double-wall constructions as well as electrical or telephone cables, plumbing or other mechanical service lines The wallboard panels 7, $7^1$ and $7^2$ are generally made of gypsum.

The above-described configuration and relative dimensions of the component parts of the one-piece stud provide sturdy support for the aligned wallboard panels in the channels and easy assembly of a double-wall construction. The above dimensions are meant as an example of an embodiment and not as a limitation. The stud is ideally suited for use in various fire-rated shaftwall, stairwall, ceiling or partition assemblies and resists deflection from lateral pressures. The stud is formed of a minimum amount of metal and hence at a lower cost.

Such a fire-rated wall will thus comprise a plurality of the present metal stud 1, spaced apart and in parallel relation, with a first set of wallboard panels 7 therebetween and held in each channel and a third wallboard panel(s) $7^1$ suitably fastened to front flange 3. An additional fourth wallboard panel(s) $7^2$ may also be suitably fastened to back flange 4.

As an example, when a stud of the present invention is compared to a stud as disclosed in U.S. Pat. No. 4,435,936, both having dimensions of 5 cm for a web height and 4 cm for front flange width, the stud of present invention uses around 25% less metal. Such a reduction in metal, and therefor in weight, can further bring reductions in shipping costs and also cause less exertion for the workers during construction.

Having described the invention, modifications will be evident to those skilled in the art without departing from the spirit of the invention, as defined in the appended claims.

I claim:

1. A one-piece metal stud comprising:

a longitudinal web with generally centrally located punch outs forming alternately oriented bent tabs substantially perpendicular to the web;

a folded and hemmed front flange substantially perpendicular to the web;

a back flange formed of alternately oriented bent tabs substantially perpendicular to the web, the bent tabs being folded over into a lip of double thickness and extending back past the web in a single thickness;

the punch out tabs and the back flange tabs being spaced apart and substantially parallel to one another thereby forming a channel therebetween on each side of the web;

whereby a separate wallboard panel can be held in each channel and a further wallboard panel or panels can be fastened to the front flange or to both the front flange and the back flange tabs to complete formation of a double-wall or cavity wall construction.

2. A one-piece metal stud as defined by claim 1 wherein the spaced apart height of the channels is substantially equal to the thickness of wallboard panels which can be held in the channels.

3. A one-piece metal stud as defined by claim 1 wherein the height of the web is more than twice the spaced apart height of the channels.

4. A one-piece metal stud as defined by claim 1 wherein the length of the back flange tabs is greater than the length of the punch out tabs.

5. A one-piece metal stud as defined by claim 1 wherein the width of the single thickness portion of the back flange tabs is substantially equal to the width of the punch out tabs.

6. A one-piece metal stud as defined by claim 1 wherein the width of the single thickness portion of the back flange tabs is substantially equal to one-half the width of the front flange.

7. A one-piece metal stud as defined by claim 1 wherein the lip of double thickness is of a width which at least hides edges, adjacent the web, of wallboard panels which can be held in the channels.

8. A one-piece metal stud as defined by claim 1 wherein the punch outs are in a portion of the web between the punch out tabs and the front flange, thereby enabling the passage of at least one of the group comprising electrical cables, telephone cables, plumbing lines and mechanical service lines, without interfering with wallboard panels which can be held in the channels.

9. A one-piece metal stud as defined by claim 1 wherein the punch outs are in a portion of the web between the punch out tabs and the front flange, thereby enabling the passage of air from one side of the web to the other.

10. A fire-rated wall comprising a plurality of spaced apart one-piece metal studs as defined by claim 1, wherein said studs are mounted in parallel relation with wallboard panels mounted therebetween, whereby a first set of separate wallboard panels are held in each channel and a third wallboard panel is fastened to the front flange.

11. A fire-rated wall as defined by claim 10, wherein a fourth wallboard panel is fastened to the back flange tabs

* * * * *

UNITED STATES PATENT AND TRADEMARK OFFICE

CERTIFICATE OF CORRECTION

PATENT NO. : 4,866,899

DATED : September 19, 1989

INVENTOR(S) : James L. Houser

It is certified that error appears in the above-identified patent and that said Letters Patent is hereby corrected as shown below:

On the title page assignee should read

--(73) Assignee: Domtar Inc. --.

Signed and Sealed this

Twenty-fifth Day of September, 1990

*Attest:*

HARRY F. MANBECK, JR.

*Attesting Officer*

*Commissioner of Patents and Trademarks*